US007736008B2

(12) United States Patent
Quattrini, Jr.

(10) Patent No.: US 7,736,008 B2
(45) Date of Patent: Jun. 15, 2010

(54) DUSTPAN WITH AN INTEGRATED ILLUMINATION SOURCE

(76) Inventor: Richard J Quattrini, Jr., 5579 Morningside Dr., San Jose, CA (US) 95138

( * ) Notice: Subject to any disclaimer, the term of this patent is extended or adjusted under 35 U.S.C. 154(b) by 66 days.

(21) Appl. No.: 11/847,773

(22) Filed: Aug. 30, 2007

(65) Prior Publication Data

US 2009/0059570 A1 Mar. 5, 2009

(51) Int. Cl.
*A47L 9/30* (2006.01)

(52) U.S. Cl. ..... 362/91; 362/119; 362/154; 362/234; 362/253

(58) Field of Classification Search ..... 362/91, 362/154, 156, 234, 253, 119
See application file for complete search history.

(56) References Cited

U.S. PATENT DOCUMENTS

| | | | | |
|---|---|---|---|---|
| 2,208,523 | A | 7/1940 | Cullman | |
| 2,889,450 | A | 6/1959 | Nordquist | |
| 4,414,612 | A | 11/1983 | Conforti | |
| 4,605,994 | A | 8/1986 | Krieg | |
| 4,662,947 | A * | 5/1987 | Hopkins | 134/6 |
| 4,926,299 | A | 5/1990 | Gilson | |
| 5,207,498 | A * | 5/1993 | Lawrence et al. | 362/91 |
| 5,896,618 | A * | 4/1999 | Woo et al. | 15/324 |
| 6,023,812 | A | 2/2000 | Morad | |
| 6,052,860 | A | 4/2000 | Coxsey | |
| 6,493,903 | B1 * | 12/2002 | Super | 15/324 |
| 6,836,285 | B1 | 12/2004 | Lubard | |
| 6,941,896 | B1 * | 9/2005 | Morin | 119/867 |
| 7,484,859 | B1 | 2/2009 | Burke | |
| 2002/0101730 | A1 * | 8/2002 | Dilger et al. | 362/91 |
| 2002/0104551 | A1 | 8/2002 | Mead | |
| 2004/0221872 | A1 | 11/2004 | Perelli et al. | |
| 2005/0071943 | A1 | 4/2005 | Liu | |
| 2006/0092378 | A1 * | 5/2006 | Marsden et al. | 352/221 |
| 2006/0180233 | A1 | 8/2006 | Perkitny | |
| 2006/0215391 | A1 | 9/2006 | Jones | |
| 2006/0273946 | A1 | 12/2006 | Krikorian | |
| 2007/0035624 | A1 | 2/2007 | Lubard | |

* cited by examiner

*Primary Examiner*—Sandra L O'Shea
*Assistant Examiner*—Meghan K Dunwiddie
(74) *Attorney, Agent, or Firm*—Bao Tran; Howard Lebowitz

(57) ABSTRACT

This invention describes a dust pan comprising a light source that is designed to illuminate a floor or other flat work surface in front of the dustpan for the purpose of locating and collecting small hard to see objects. This can be for the purpose of cleaning or simply locating a small valuable object. The light source is fashioned such that it provides a very low grazing angle of illumination that it skims across a surface. Small objects or particles are visible as being brighter than the surroundings and set off by a long shadow on the side of the particle away from the light.

20 Claims, 8 Drawing Sheets

DUSTPAN WITH AN INTEGRATED ILLUMINATION SOURCE

BACKGROUND OF THE INVENTION

1. Field of the Invention

The field of the invention includes dustpans equipped with one or more light sources of a type which will illuminate the surface in front of the dustpan with a low grazing angle light beam that skims along the surface. Such a device is particularly useful for locating and collecting very small hard to find items.

2. Description of the Prior Art

When cleaning dirt or debris from a floor, it is often hard to see everything that needs to be cleaned up. This is especially true for broken glass. The problem is compounded when the debris or glass is on a floor that provides low contrast or the debris is being cleaned under poorly lit conditions.

The problem which is solved is illustrated by a drinking glass broken on the floor. The impact of the glass on the floor may send chards tens of feet in different directions. The chards become a safety hazard if not located and cleaned immediately. In the time period right after the glass is cleaned people are often extra careful where they step and what they wear on their feet. As time passes, people forget about the incident and become less concerned with any safety issues. An unnoticed and removed piece of glass can be a safety hazard for days, weeks, and even months after the incident. The glass becomes a hazard for people in bare feet, crawling babies, and pets.

Another related problem is locating valuable small items which have been dropped onto the floor. Examples of such items are a contact lens, backs of earrings, and other jewelry parts.

A solution to the problem requires a means for locating the small items and a means for collecting the items once located.

One type of solution that has been proposed is a vacuum cleaner with integral lights. U.S. Pat. Nos. 1,996,934, 2,088,482, 2,208,523, and 2,594,524 describe devices involving placing lights on a suction cleaning device. This type of device is certainly valuable, but has several drawbacks. First, the lights are not particularly designed to make small particles stand out from the background. Second, a suction device is well suited to the situation requiring general clean up of debris, but not to the situation where it is desired to locate and recover valuable items such as a lost contact lens or jewelry part without damaging the item. Third, the suction device is ineffective at cleaning very small particles from a hard floor, since the suction may not be strong enough to lift the small particles and the brushes do a poor job of scooping up the chards from a hard floor.

For many years the concept of illuminating an object with a low grazing angle light has been used in microscopy and industrial machine vision applications for the purpose highlighting defects or particles on relatively flat surfaces. This is sometimes referred to as "dark field illumination." The fundamental concept is to use lighting at an angle to the surface such that anything that sits on or protrudes from the surface will scatter light up to an eye, a detector or a camera. Light that is reflected directly from the surface itself will never reach the eye, detector or camera. For noisy backgrounds or difficult to see objects, this concept can be taken to extremes such that the illumination source is at a very low grazing angle with respect to the surface. This can form an even higher contrast between the surface and any objects on the surface so that they can easily be detected. The low grazing angle minimizes any reflection from the flat surface while maximizing the reflection from the objects on the surface. In cases where the illumination is coming from a single direction, any objects on the surface will also cast a long shadow behind the object thus making them easier to find. Grazing angle is defined as the angle between a light beam and a surface (i.e. 90 degrees minus the angle of incidence). This concept has not been adapted for finding non-microscopic small particles on ordinary room sized surfaces.

There is a need for a cleaning tool which will optimally illuminate small items on a planar surface and provide a means for recovering said small items.

There is a need for a cleaning tool capable of resting flat on a planar surface and providing illumination with one or more light sources, which provide illumination of the surface in an area extending from immediately adjacent to the one or more lights and for a further distance from the one or more light sources, wherein said illumination is characterized by a low grazing angle that will illuminate small items on the planar surface. The light will also cast a long shadow behind any object (on the side opposite the light source).

There is a need for a cleaning tool capable of resting flat on a planar surface and providing illumination with one or more light sources, which provide illumination of the surface in an area extending from immediately adjacent to the one or more light sources and for a further distance from the one or more light sources, wherein said illumination is characterized by a grazing angle less than 10 degrees.

There is a need for a cleaning tool capable of resting flat on a planar surface and providing illumination—with one or more light sources, which provide illumination of the surface in an area extending from immediately adjacent to the one or more light sources and for a further distance from the one or more light sources—, wherein said illumination is characterized by a grazing angle less than 6 degrees.

There is a need for a cleaning tool capable of resting flat on a planar surface and providing illumination with one or more light sources, which provide illumination into areas with low ambient light levels such as under furniture, under a workbench, under an automobile or other darkened area.

SUMMARY OF THE INVENTION

One preferred embodiment of the invention is a dustpan with one or more light sources integral thereto which light sources are well suited to illuminating a floor or other planar surface for the purpose of locating small, hard to see items, including but not limited to finding glass, small shards or debris, contact lenses, earring backs, tiny screws, and the like, and providing a receptacle to accumulate the located items. The one or more light sources produce a very low grazing angle illumination that skims across the planar surface. For the purposes of this application—grazing angle is defined as the angle between a light beam and a surface (i.e. 90 degrees minus the angle of incidence).

The instant invention builds on the concept of dark field illumination which has been used in microscopy and industrial machine vision applications to highlight defects on flat surfaces. The fundamental concept is to use lighting at an angle to the surface such that anything that sits on or protrudes from the surface will scatter light upwards to an eye, a detector or a camera. Light that is reflected directly from the surface will never reach the eye, detector or camera.

For noisy backgrounds or difficult to see objects, the concept of dark field illumination can be taken to extremes such that the illumination source is at a very low grazing angle with respect to the surface. This can form an even higher contrast between surface and any objects on the surface so that they can easily be detected.

With a properly designed illuminated dustpan, a low grazing angle dark field concept can be applied for the simple application of locating broken glass, dirt, or other small objects on a floor or flat surface. If a person is looking down onto a floor or flat surface that is illuminated with low grazing angle illumination, the person will observe the same affect that a camera or detector would in dark field illumination. The light scattering from an object sitting on the surface will be much brighter than the light reflected from the surface. Furthermore, if the illumination is coming from only one direction, a long shadow will be cast immediately behind any object in the path of the light. This long shadow provides further contrast of normally hard to see particles on a surface.

A preferred dustpan comprises:

a) a debris receptacle capable of resting flat on a planar surface, b) at least one body section attached to the debris receptacle, and c) at least one light producing structure, mounted in said at least one body section, said at least one light producing structure comprising;

i) at least one light source mounted in the at least one light producing structure, ii) at least one light shaping means mounted in the at least one light producing structure, said at least one light shaping means being capable of providing illumination of the surface in an area extending from immediately adjacent to the dustpan and for a further distance from the dustpan, wherein said illumination is characterized as having a low grazing angle, and iii) whereby said light is focused at an angle nearly parallel to the surface.

There are preferably either one or two light producing structures but there may be more. than two lights. An example of where there would be more than two lights is an array of light producing structures such as light emitting diodes (LED's).

Several embodiments of the light shaping means comprise a reflector, a reflector in series with a cylindrical lens, and a reflector in series with a fresnel lens.

A low grazing angle may be less than 30 degrees, preferably less than 10 degrees and more preferably less than 6 degrees.

The light can be of any useful intensity but preferably should be between 500-5000 lux and more preferably 800-5000 lux at a distance of up to 5 feet from the source and preferably at least 10 feet.

The dustpan is used by putting it flat on the surface and allowing the light to illuminate the surface, and look for small articles on the surface. The dustpan may be systematically moved from place to place until the entire surface in question is inspected and/or cleaned. It is an object of the invention to supply an illuminated dustpan which will optimally illuminate small items on a planar surface.

It is a further object of the invention to supply an illuminated dustpan with a debris receptacle which is capable of resting flat on a planar surface and a light source providing illumination of the surface in an area extending from immediately adjacent to the dustpan and for a further distance from the dustpan, wherein said illumination is characterized by a low grazing angle that will illuminate small items on the planar surface. The light will also cast a long shadow behind any object (on the side opposite the light source).

It is a still further object of the invention to supply an illuminated dustpan capable of resting flat on a planar surface and providing illumination of the planar surface in an area extending from immediately adjacent to the dustpan and for a further distance from the dustpan, wherein said illumination is characterized by a grazing angle less than 10 degrees.

BRIEF DESCRIPTION OF THE DRAWINGS

These and other features, aspects and advantages of the present invention will become better understood with regard to the following description, appended claims and accompanying drawings, where:

Figure 2A:
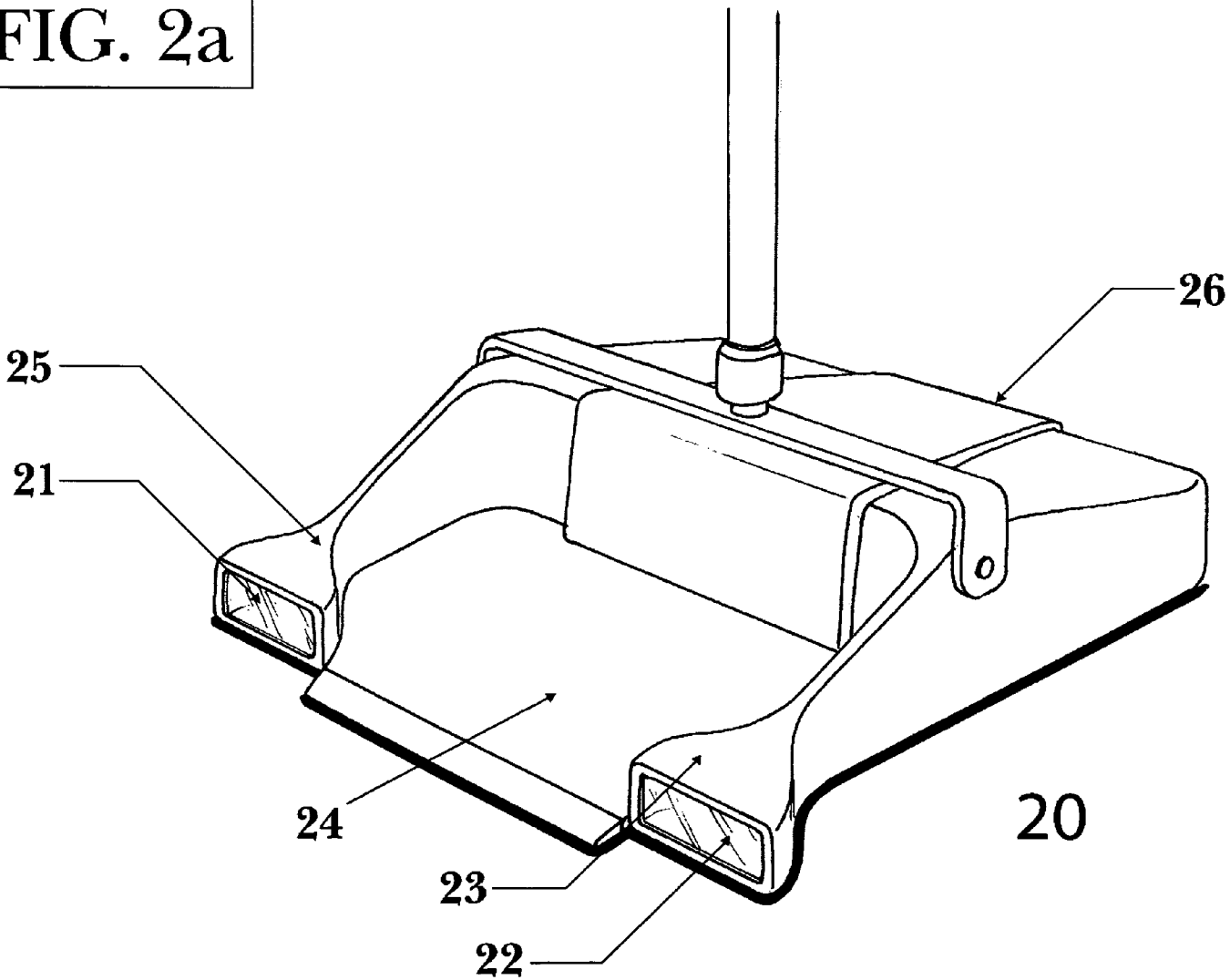
FIG. 2A is a view of a long handle upright dustpan with two light sources.
Figure 2B:
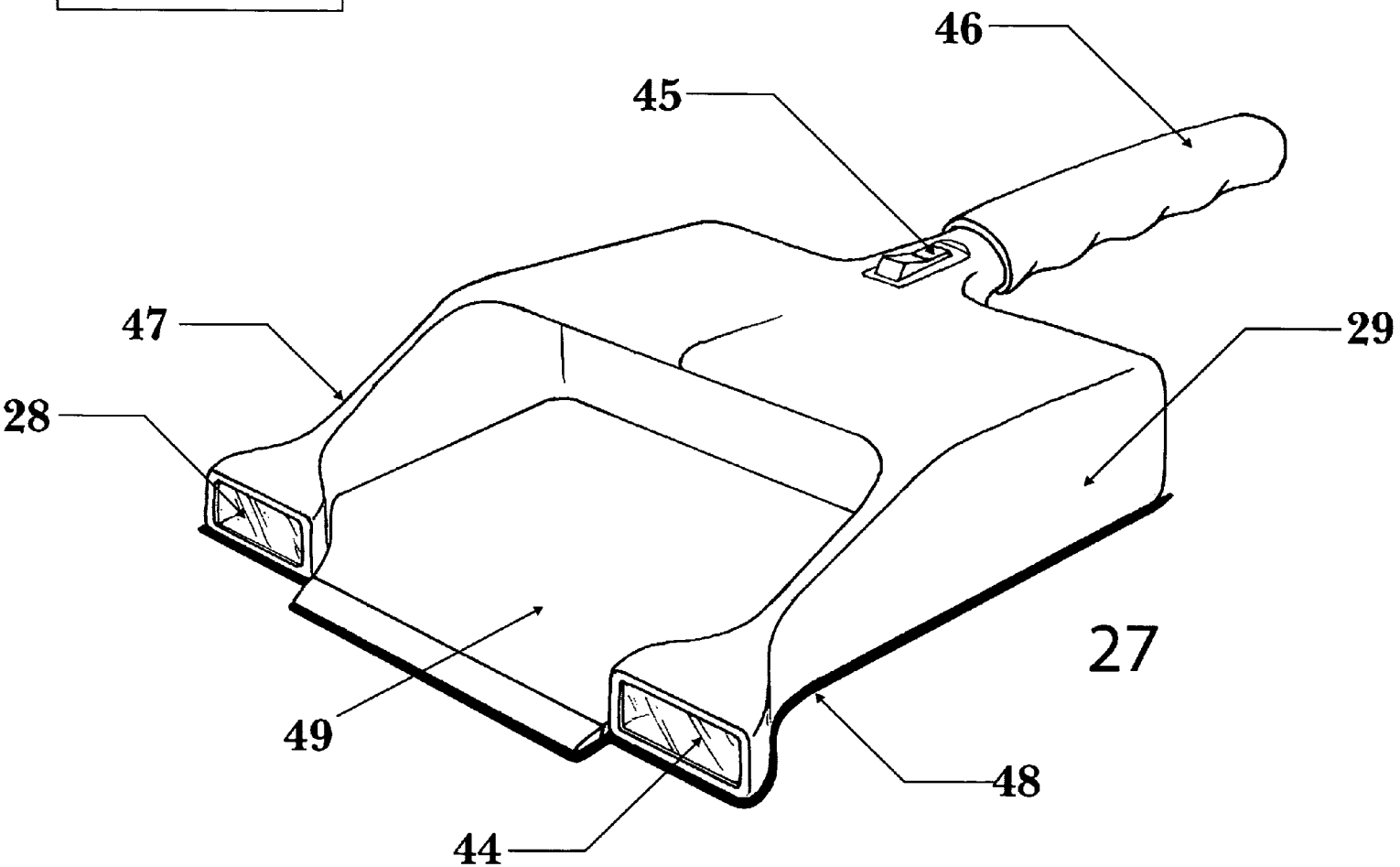
FIG. 2B is a view of a hand held dustpan with two light sources.
Figure 2C:
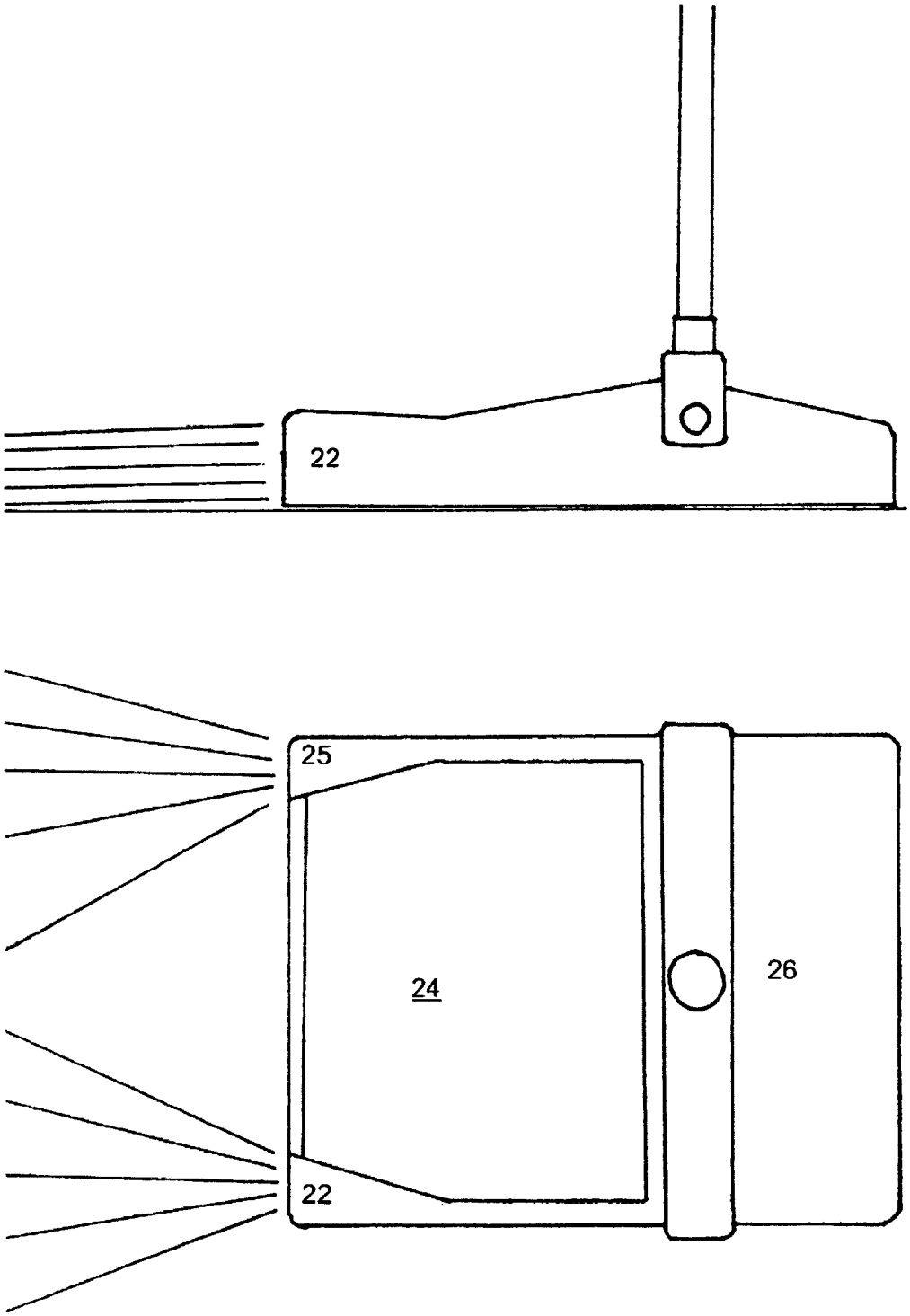

*Fig.* 2C shows a side view and top view of the dustpan of FIG. 2B.

Figure 3:
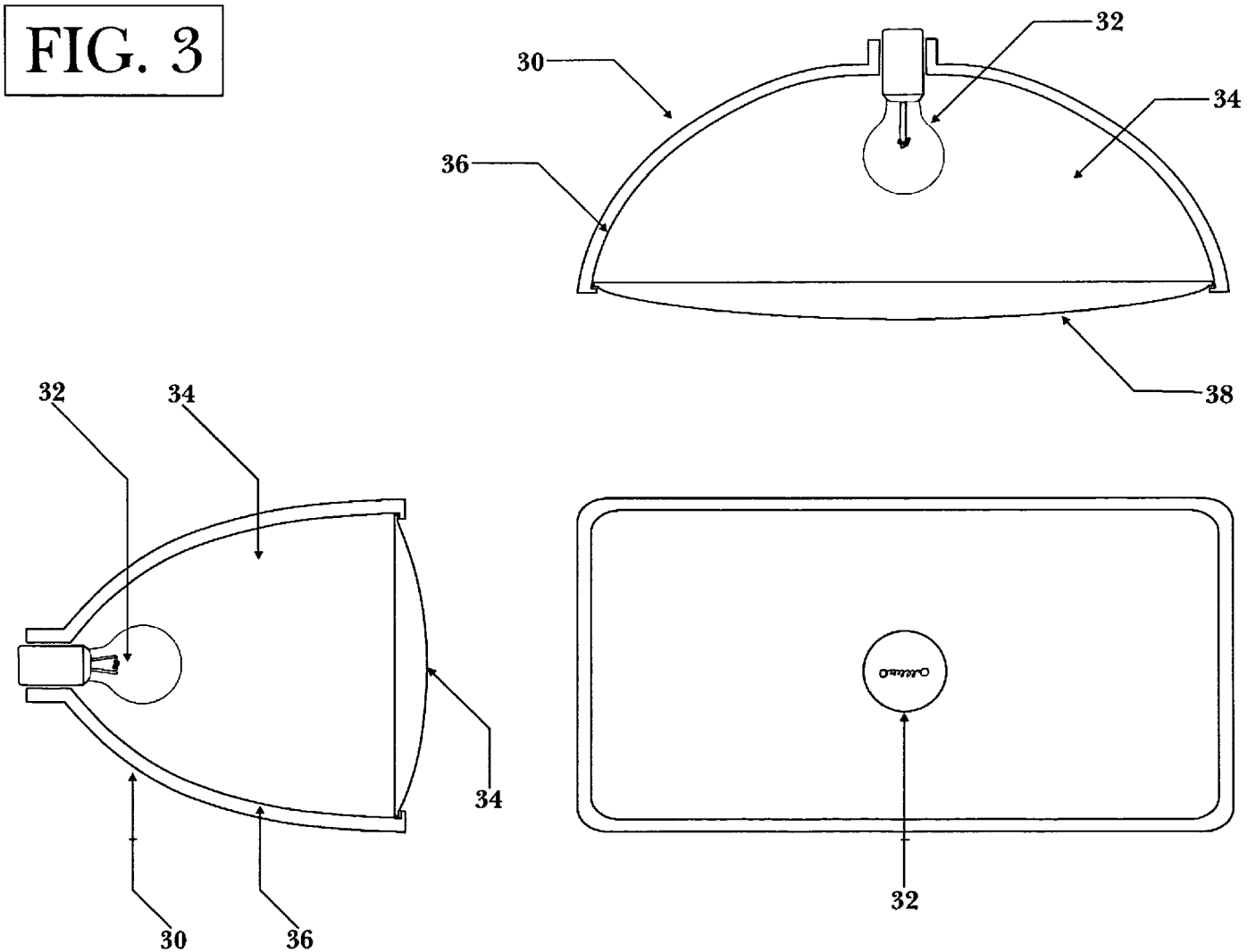

FIG. 3 shows top, side, and front views of a light producing structure comprising a reflector and a cylindrical lens.

Figure 4:
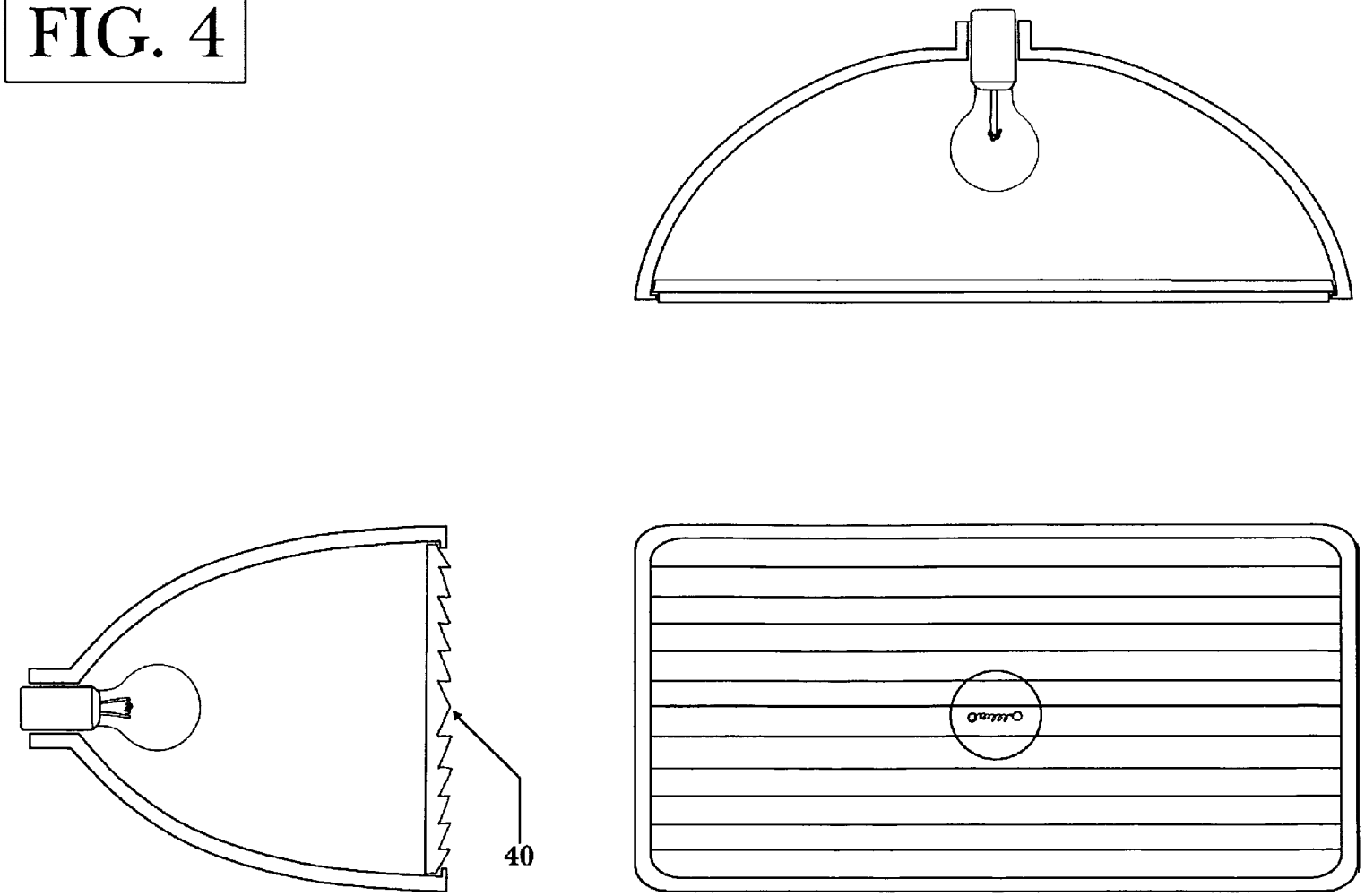

FIG. 4 shows top, side, and front views of a light producing structure comprising a reflector and a fresnel lens.

Figure 5:
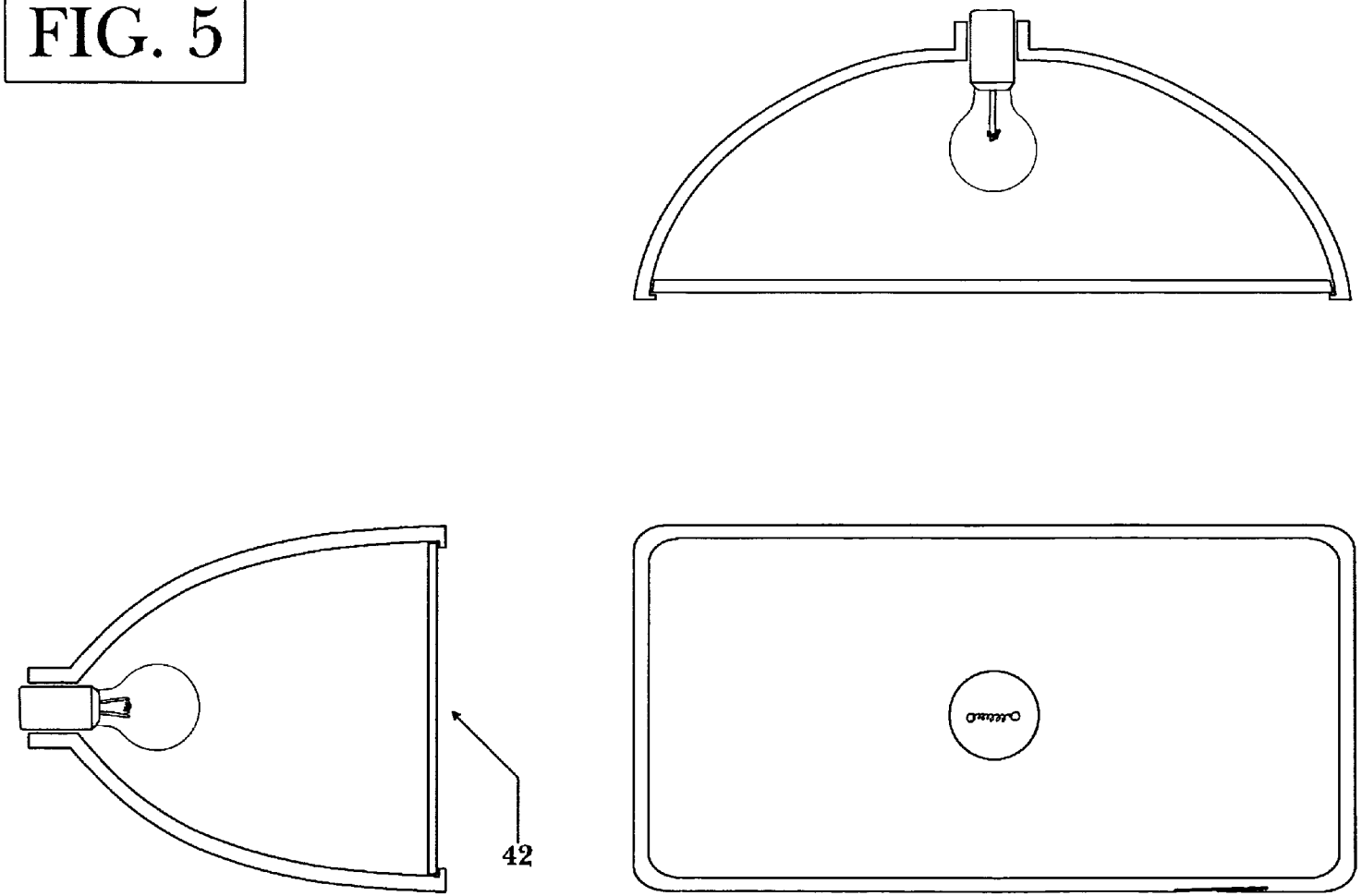

FIG. 5 shows top, side, and front views of a light producing structure comprising a reflector and a plano lens.

DESCRIPTION OF THE PREFERRED EMBODIMENTS

One preferred embodiment of the invention is an illuminated dustpan with one or more light sources to illuminate a floor or other planar surface for the purpose of locating small, hard to see items, including but not limited to finding glass, small shards or debris, contact lenses, earring backs, tiny screws, and the like, and capturing the items in the dustpan receptacle. The light sources produce a very low grazing angle illumination that skims across the planar surface. For the purposes of this Application, grazing angle is the angle between a light beam and a surface (i.e. 90 degrees minus the angle of incidence).

With a properly designed dustpan, a low grazing angle can be applied for the simple application of locating broken glass, dirt, or other small objects on a floor or flat surface. If a person is looking down onto a floor or flat surface that is illuminated with uniform low grazing angle light will observe that the light reflected from small objects will be much brighter than the light reflected from the surface. Furthermore, if the illumination is coming from only one direction, a long shadow will be cast immediately behind any object in the path of the light. This long shadow provides further contrast of normally hard to see particles on a surface and sets off the small object.

Figure 1A:
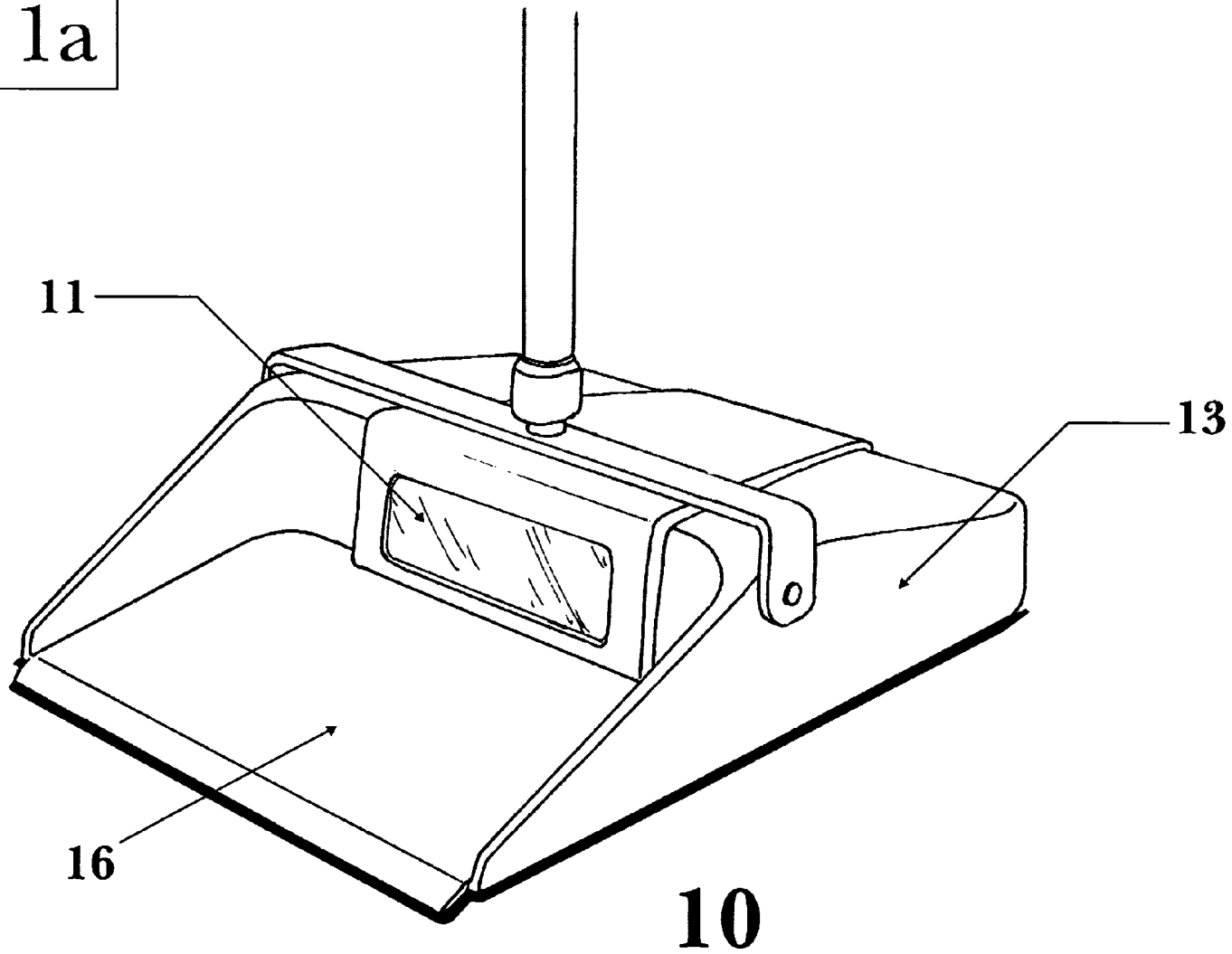
FIG. 1A is a view of a long handle upright dustpan with a single light source.

Moving to the Figures, FIG. 1A shows a long handle upright dustpan 10 with a single light producing structure 11 (only the exit is visible in this view) The remainder of the structure is within the body section 13, which also contains room for the battery compartment. The debris receptacle 12 rests flat on the floor ahead of the light producing structure 11.

Figure 1B:
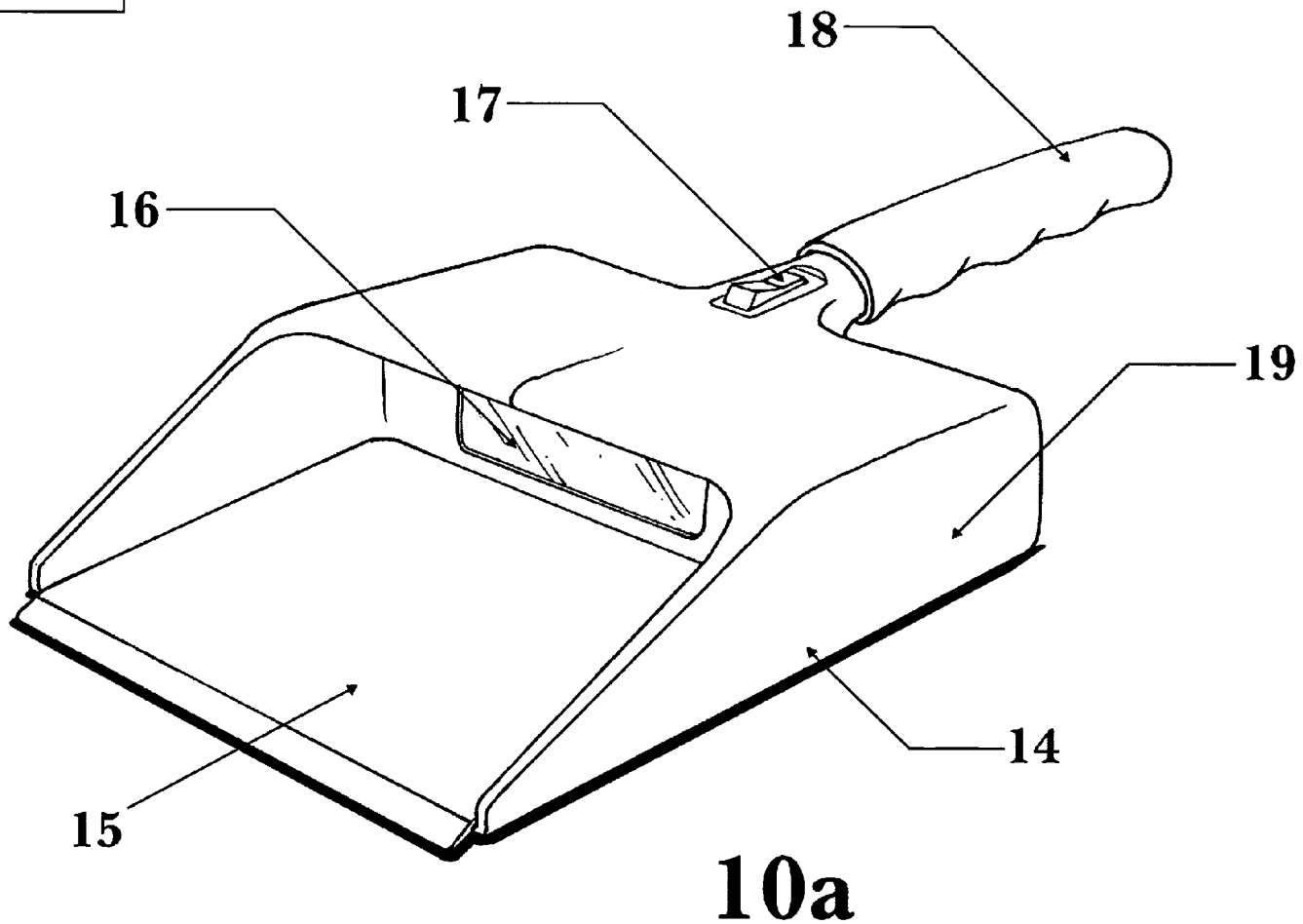
FIG. 1B is a view of a hand held dustpan with a single light source.

FIG. 1B shows the handheld version 10A of a single light producing structure dustpan. The exit of the light producing structure 16 is at the back of the debris receptacle 15. The remainder of the light producing structure is not shown on this view, but is contained in the body section 19, which also contains the battery compartment. A switch 17 is shown on handle 18.

FIGS. 2A and 2B show a long handled two light source dustpan 20 and a handheld two light source dustpan 27, respectively. In FIG. 2A, the exits of the two light producing structures 21 and 22 are at the ends of the left body extension 25 and the right body extension 23, respectively. The debris receptacle 24 is between the left and right body extensions. The battery compartment is in the rear compartment 26.

FIG. 3 shows the side, top, and front views of the light producing structure of one preferred embodiment of the light producing structure. The light producing structure comprises: a body 30, a light-source 32 mounted in the body, and a light shaping means 34 mounted in the body, capable of providing illumination of the surface in an area extending from immediately adjacent to the light and for a further distance from the light. The illumination is characterized by a low grazing angle. In this case the light shaping means comprises an internal reflector 36, and a cylindrical lens 38.

A low grazing angle is preferably less than 30 degrees more preferably less than 10 degrees, and most preferably between to 6 degrees and 0 degrees (inclusive), where 0 is a beam of light parallel to the floor.

The brightness of the light should be at least 500 lux on the floor at a distance from less than one foot and to at least 5 feet from the source. More preferably the brightness should be greater than 2500 lux and most preferably greater than 5000 lux. It is most preferable to cast the beam on the floor at distances up to 5 feet, most preferably at least 10 feet.

The bodies and light producing structures are preferably made by injection molding plastic. The construction is conventional and will be well known to those skilled in the art. Similarly, the optics of the lens and reflector is conventional for a particular size of light producing structure and will be calculated by ordinary physics.

The light source can be of any type. Some examples include incandescent, tungsten, krypton, xenon, LED's, LED arrays, scanning lasers, etc. An important aspect here is that the light source is preferably within about one to four inches of the surface such that can be positioned close enough to the surface to form a low grazing angle and is shaped or focused for uniform lighting that skims across the surface. There can also be multiple light sources within one device to provide a wider area of coverage.

FIG. 4 shows an alternative embodiment, with the shaping means comprising a reflector and a fresnel lens 42 in place of the cylindrical lens 38 in FIG. 3, and which is otherwise identical to FIG. 3.

FIG. 5 shows another-alternative embodiment, with the shaping means comprising a reflector and a plano lens 42 in place of the cylindrical lens 38 in FIG. 3, and the fresnel lens 42 in FIG. 4, and which is otherwise identical to FIGS. 3 and 4.

Although the present invention has been described in considerable detail with reference to certain preferred versions thereof, other versions are possible. Therefore the spirit and scope of the appended claims should not be limited to the preferred versions herein.

What is claimed is:

1. An illuminated dustpan comprising a) a dustpan with a debris receptacle resting flat on a planar surface to store debris swept into the debris receptacle by a broom, b) at least one body section attached to the debris receptacle, and c) at least one light producing structure, mounted in said at least one body section, said at least one light producing structure comprising;

i) at least one light source mounted in the at least one light producing structure, ii) at least one light shaping means mounted in the at least one light producing structure for focused, low grazing angle illumination, said at least one light shaping means being capable of providing illumination of the surface in an area extending from immediately adjacent to the dustpan and for a further distance from the dustpan, wherein said illumination is characterized as having a low grazing angle, and iii) whereby said light is focused at an angle nearly parallel to the surface.

2. The illuminated dustpan of claim 1, wherein said light shaping means comprises a reflector and a lens.

3. The illuminated dustpan of claim 2, wherein the lens comprises a cylindrical lens.

4. The illuminated dustpan of claim 1, wherein said light shaping means comprises a reflector.

5. The illuminated dustpan of claim 2, wherein the lens is a fresnel lens.

6. The illuminated dustpan of claim 1, wherein the low grazing angle is less than 30 degrees.

7. The illuminated dustpan of claim 6, wherein the grazing angle is less than 10 degrees.

8. The illuminated dustpan of claim 7, wherein the grazing angle is in the range between six and zero degrees inclusive.

9. The illuminated dustpan of claim 6, wherein the illumination of the surface is at least 500 lux on the surface at a distance from less than one foot to at least 5 feet from the dustpan.

10. The illuminated dustpan of claim 6, wherein the illumination of the surface is at least 2500 lux on the surface at a distance from about one foot to at least 5 feet from the dustpan.

11. The illuminated dustpan of claim 6, wherein the illumination of the surface is at least 5000 lux on the surface at a distance from about one foot to at least 5 feet from the dustpan.

12. The illuminated dustpan of claim 6, wherein the illumination of the surface is at least 500 lux on the surface at a distance from about one foot to at least 10 feet from the dustpan.

13. The illuminated dustpan of claim 6, wherein the illumination of the surface is at least 2500 lux on the surface at a distance from less than one foot to at least 10 feet from the dustpan.

14. The illuminated dustpan of claim 6, wherein the illumination of the surface is at least 5000 lux on the surface at a distance from less than one foot to at least 10 feet from the dustpan.

15. The illuminated dustpan of claim 1, wherein said light source is positioned close enough to the surface to form a beam on the surface with low grazing angle.

16. The illuminated dustpan of claim 15, wherein said light source is in the range of about one to four inches above the planar surface when the dustpan sits on the planar surface.

17. The illuminated dustpan of claim 1, wherein said high intensity light source comprises a light chosen from the group consisting of incandescent, tungsten, krypton, xenon, LED's, LED arrays, and scanning lasers.

18. The illuminated dustpan of claim l, wherein the at least one body section comprises at least two body sections.

19. The illuminated dustpan of claim 18, wherein the at least one light producing structure, comprises at least two light producing structures.

20. An illuminated apparatus comprising a) a dustpan with a debris receptacle resting flat on a planar surface to store debris swept into the debris receptacle by a broom, b) at least one body section attached to the debris receptacle, and c) at least one light producing structure, mounted in said at least one body section, said at least one light producing structure comprising;

i) at least one light source mounted in the at least one light producing structure, ii) at least one light shaper mounted in the at least one light producing structure, said at least one light shaper being capable of providing illumination of the surface in an area extending from immediately adjacent to the dustpan and for a further distance from the dustpan, wherein said illumination is characterized as having a low grazing angle, and iii) whereby said light is focused at an angle nearly parallel to the surface.

* * * * *